United States Patent [19]

Dimitrov

[11] 4,272,034

[45] Jun. 9, 1981

[54] SPOOL-CHARGING DEVICE FOR AUTOMATIC-WINDING-MACHINE MAGAZINES

[75] Inventor: Milko D. Dimitrov, Sofia, Bulgaria

[73] Assignee: SK "Pamukotex", Sofia, Bulgaria

[21] Appl. No.: 35,093

[22] Filed: May 1, 1979

Related U.S. Application Data

[63] Continuation-in-part of Ser. No. 917,501, Jun. 21, 1978, abandoned, which is a continuation of Ser. No. 740,739, Nov. 10, 1976, abandoned.

[51] Int. Cl.[3] ..... B65H 54/26; B65H 67/02

[52] U.S. Cl. ..... 242/35.5 R; 242/35.5 A; 242/35.6 E

[58] Field of Search ..... 242/35.5 A, 35.5 R, 242/35.6 R, 35.6 E

[56] References Cited

U.S. PATENT DOCUMENTS

| | | | |
|---|---|---|---|
| 3,153,513 | 10/1964 | Furst et al. | 242/35.6 E |
| 3,279,710 | 10/1966 | Raasch | 242/35.5 R |
| 3,295,775 | 1/1967 | Raasch et al. | 242/35.6 E |
| 3,381,908 | 5/1968 | Iqushi et al. | 242/35.5 R |
| 3,389,866 | 6/1968 | Mullers | 242/35.5 R |
| 3,421,705 | 1/1969 | Benedict | 242/35.5 R |
| 3,471,101 | 10/1969 | Moyer et al. | 242/35.6 R |
| 3,480,216 | 11/1969 | Iannucci et al. | 242/35.5 R |
| 3,850,378 | 11/1974 | Savio | 242/35.6 E X |
| 3,941,323 | 3/1976 | D'Agnolo et al. | 242/35.6 E X |
| 4,010,907 | 3/1977 | Nishiyama et al. | 242/35.6 E X |

*Primary Examiner*—Stanley N. Gilreath
*Attorney, Agent, or Firm*—Karl F. Ross

[57] ABSTRACT

A device for charging thread spools into the magazine of an automatic winding machine which comprises, on a support frame, a bin containing the previously oriented spools and having a discharge slot flanked by a fork which grips the spools axially and removes them from the bin. One arm of the fork is provided with a frictionally driven grip while the other arm of the fork carries an electromagnet pressing an opposite grip against the opposite end of the spool into the region of a blowing funnel and an aspirator whereby a thread end is uncoiled by the gently blowing and suction action and the rotation of the spool. Another electromagnet triggers the feed of the spool along a ramp into a socket of the winding machine magazine while a pneumatic cylinder carries the uncoiled thread end to the aspirator thereof.

7 Claims, 5 Drawing Figures

SPOOL-CHARGING DEVICE FOR AUTOMATIC-WINDING-MACHINE MAGAZINES

CROSS REFERENCE TO RELATED APPLICATION

This application is a continuation-in-part of Ser. No. 917 501 filed June 21, 1978 (now abandoned) as a continuation of Ser. No. 740 739 filed Nov. 10, 1976 (now abandoned).

FIELD OF THE INVENTION

The invention relates to a device for charging automatic-winding-machine magazines with spools.

BACKGROUND OF THE INVENTION

Devices for charging automatic-winding-machine magazines with spools of a stationary type are well known. These devices include a mechanism for arranging and orienting full spools, a mechanism for preparing the end of the thread beforehand by means of an aspiration mechanism, a transport conveyor belt for carrying the ready spools to the empty sockets of the winding-machine magazine and an aspiration mechanism in the magazine itself for picking up the thread end from the tube of the spool.

With such devices it is necessary to prepare in advance the thread end which is first inserted into the case of the spool or caught by a removable clip for transportation to the winding-machine magazine, after which that same end is taken out of the tube of the spool by the clip carrying it, entrained by the magazine's aspiration mechanism. The use of a transport belt for supply of the initially prepared spools and the charging system itself for each winding machine make the winding machine construction even more complicated and expensive.

OBJECTS OF THE INVENTION

It is therefore an object of the present invention to provide a simple removable device for charging the magazine of an automatic-winding machine which does not call for any reconstruction of the latter.

It is another object of the present invention to avoid the preliminary insertion of the thread end into the case of the spool or its being entrained by a special mechanism of the transport belt for delivering it from the preparation station to the winding-machine magazine and its repeated transfer to the aspiration mechanism of the latter.

SUMMARY OF THE INVENTION

This object is resolved by hanging a removable frame carrying a casket or bin with preliminarily arranged and oriented spools on a support rail provided on an automatic-winding machine. One end of the bin is formed with discharge slots embraced laterally by a forklike clip with freely rotating jaws, the fork being displaced by a toothed rack along two vertical guides. An electromagnet is attached to one of the jaws of the fork while the other is connected with a rubber roller which is given a rotative motion through a continuously driven roller attached to the frame of the spool charging device. The fork engages the spool axially.

When the fork is in its lower final position the spool lies between blowing and aspiration funnels disposed tangentially to the spool. The funnels lie in the same plane and move parallel to the spool axis.

Below the fork there is an inclined ramp or trough which guides the free spool to the empty socket of the automatic-winding-machine magazine.

Below the trough, to a bar hinged on the frame of the device, there is attached an electromagnet. The armature of the electromagnet, when engaged in the profiled slots of an indexing rail attached to the support rail, directs a pneumatic cylinder connected to the same bar in a sweeping motion when the spool charging device moves relative to the winding machine. The piston of that pneumatic cylinder ends in another fork which serves to lead the thread in a sweeping motion past an aspirator of the winding-machine magazine so that it may be more easily captured.

Immediately above the inclined groove there is a photoreflection element trained along the axis of the spool sockets in the winding-machine magazine. The photoreflection element registers the presence of empty sockets in the magazine.

An additional indexing rail is attached to the support rail of the winding machine, with slots formed at a spacing corresponding to the spacing at which the spools in the magazine are arranged. The armature of another electromagnet reaches into the slots in response to the photoreflection element in order to bring the apparatus to a stop with the trough directed toward an empty spool socket.

At this point, also in response to the photoreflective element, a spool is advanced to the discharge slot of the bin and engaged by the jaws of the fork and lowered to the release position where the spool is rotated in a direction opposite to the winding of the thread, thereby allowing the thread end to be loosened by the blowing funnel and captured by the aspiration funnel. The spool is then released from the fork and directed by the trough to an empty spool socket, interrupting the light beam of the photoreflective element, and, in response to this, the pneumatic cylinder extends the other fork to engage the trailing thread. The spool charging device then advances along the support rail, causing the thread engaging fork, which is still engaged in the slot of the indexing rail, to make a sweeping motion, drawing the thread past the aspirator provided on the winding machine and captured thereby, while at the same time, the trailing thread still engaged by the aspirator on the spool lowering fork is severed.

The advantage of this invention is that by means of one charging station for orientation and arrangement of the spools, one can serve a number of devices using to the maximum the full capacities of the charging station.

BRIEF DESCRIPTION OF THE DRAWING

The above and other objects, features and advantages of the present invention will become more readily apparent from the following description, reference being made to the accompanying drawing, in which.

SPECIFIC DESCRIPTION

Figure 1:
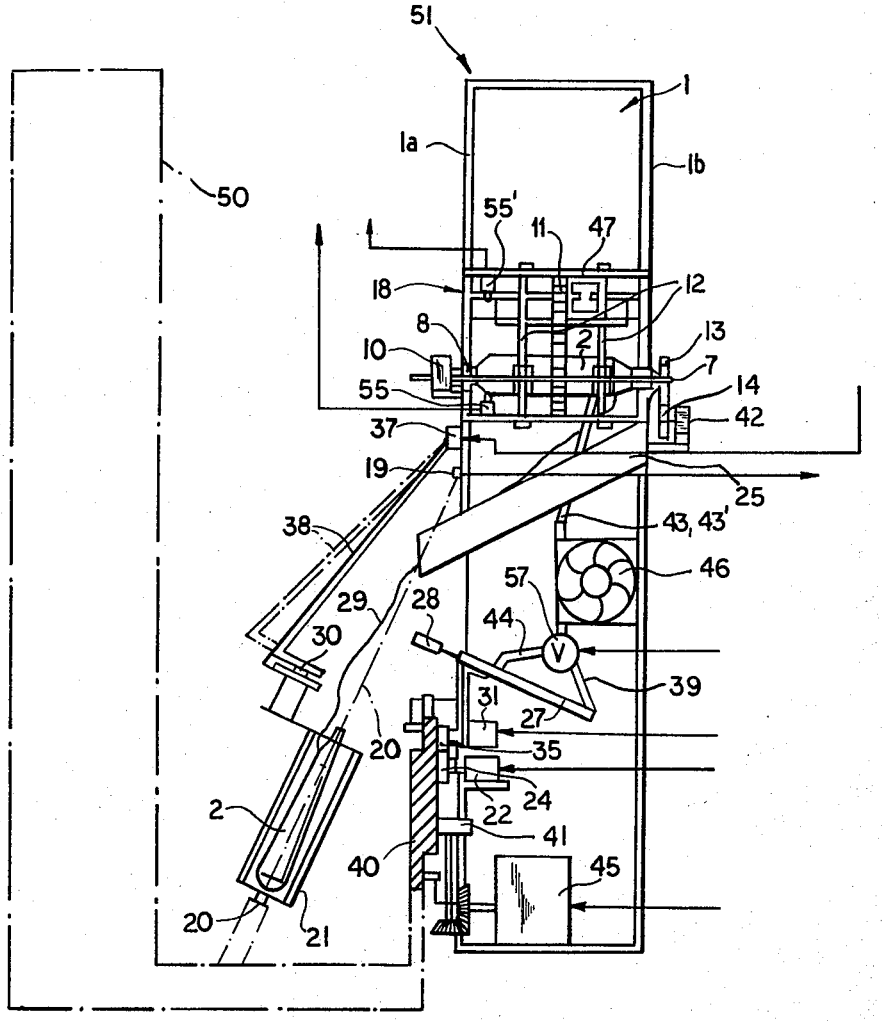
FIG. 1 is a diagrammatic view of the device seen from one side.
Figure 2:
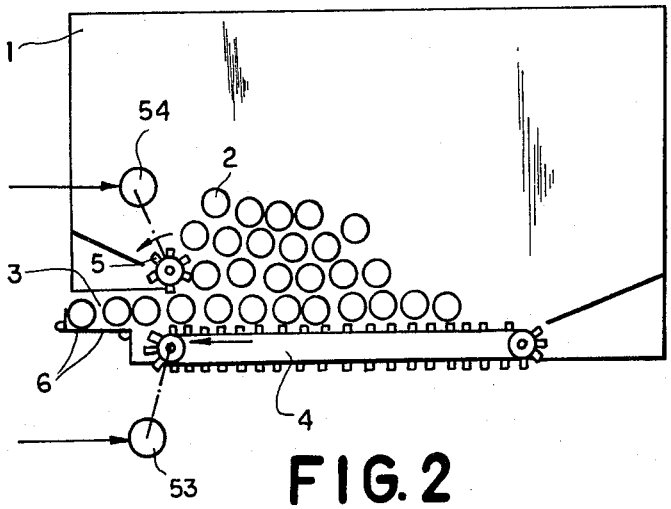
FIG. 2 is a front view of the bin carrying the arranged and distributed spools.
Figure 3:
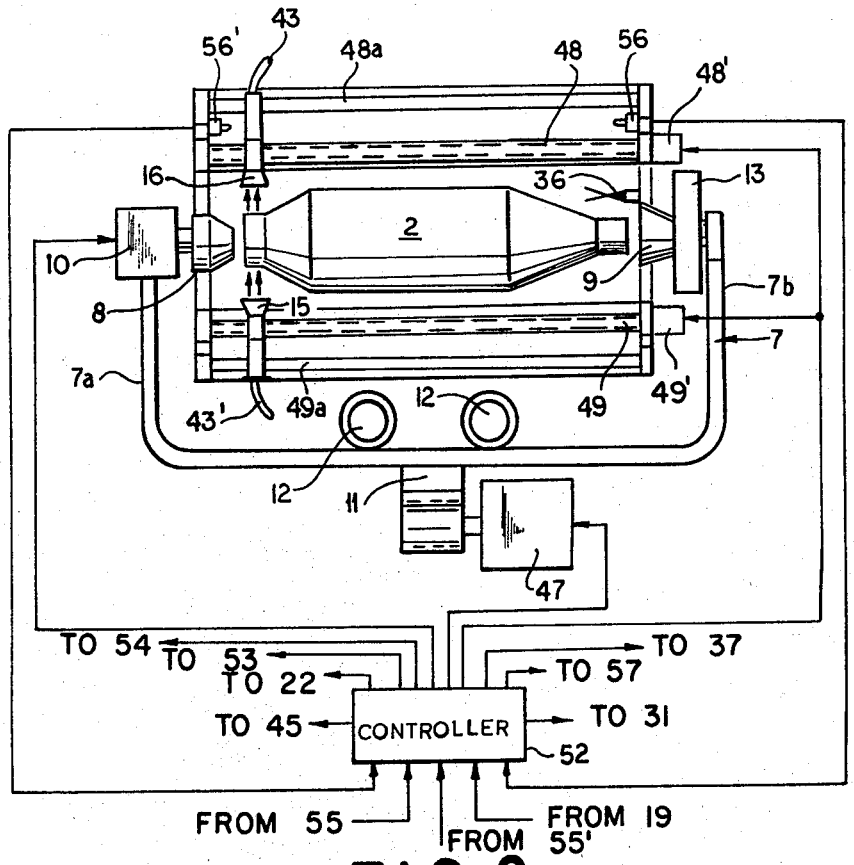
FIG. 3 is a view from above of the clip gripping the spool axially.
Figure 4:
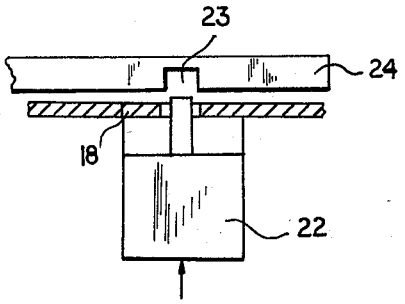
FIG. 4 is a view from above of one indexing rail and the electromagnet for bringing the apparatus to a stop.
Figure 5:
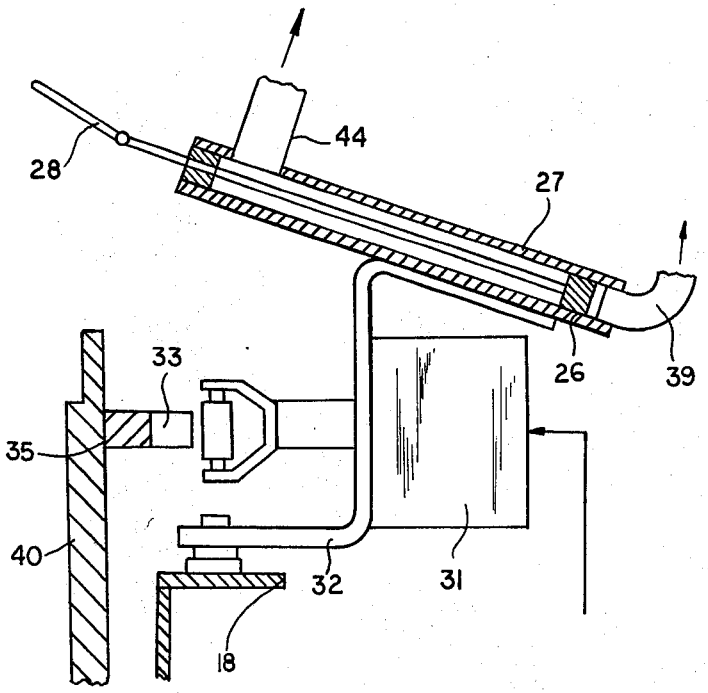
FIG. 5 is a side view of the fork for orienting and directing the end of the thread.

The device 51 comprises a bin or box 1 mounted on a frame 18, having a discharge groove or slot 3 ending with pivotable plates 6. Above the discharge slot 3 there is a rotating toothed cylinder 5 driven by means not shown. The bin bottom is formed by a corrugated endless belt 4 driven by means not shown.

A fork 7 has arms 7*a* and 7*b* flanking the slot 3 which is defined by slots in walls 1*a* and 1*b* of the bin 1. The fork 7 is displaced along vertical guides 12 attached to frame 18 and has on both arms 7*a*, 7*b* freely rotating conical jaws 8, 9, jaw 8 being connected with the armature of electromagnet 10 attached to one arm of fork 7 and jaw 9 having a rubber roller 13. Rack 11, driven by the pinion of a reversible motor 47 mounted on frame 18, is attached to fork 7.

A motor 42 is mounted laterally on frame 18 and has a rubber roller 14 which engages and frictionally drives roller 13 in the lowered position of fork 7.

Leadscrews 48 and 49, parallel to guides 48*a* and 49*a*, are mounted on frame 18 and rotated by means of reversible motors 48' and 49'. Blowing funnel 15 and aspiration funnel 16 move along guides 48*a* and 49*a* as displaced by the leadscrews and in the lower final position of fork 7 that are oriented tangentially to spool 2. Blowing funnel 15 and aspiration funnel 16 are connected through air tubes 43, 43' with blower 46.

A photoreflection element 19 is mounted on frame 18 of the device. It is trained so that its reflection axis 20 lies along the axis of socket 21 of the magazine of the winding machine 50, shown in phantom lines in FIG. 1.

A sloping trough or ramp 25 is formed below the bottom position of fork 7 so that when the armature of electromagnet 22 attached to frame 18 engages slot 23 of an indexing rail 24, sloping ramp 25 is aligned with a socket 21 in the magazine of the winding machine. Indexing rail 24 is attached immovably to a support rail 40 on the winding machine 50.

A bar 32 is hinged on frame 18 adjacent support rail 40. On the upper side of bar 32 a pneumatic cylinder 27 is disposed, the piston 26 of which ends in a fork 28 used to guide thread 29 to aspirator 30. The vertical side of bar 32 carries electromagnet 31 whose armature is turned toward profiled slots 33 of indexing rail 35 rigidly connected to rail 40 of the winding machine 50.

On its way to its final position, aspirator 16 approaches scissors 36 supported on frame 18 for severing trailing thread 29.

Electromagnet 37 is attached to frame 18. The armature of electromagnet 37 is hinged on deviator 38 attached thereto for swinging the deviator to open and close aspirator 30.

The entire device 51 is mounted on the rail 40 of the winding machine, moving on the latter by means of rollers 41 driven by motor 45.

The device operates in the following way:

Spools 2 arranged in advance in bin 1 are advanced in turn to discharge slot 3 by the corrugated endless tape 4 and the cylinder 5 thereabove which impedes, by its reverse rotation, the simultaneous passage of two spools through slot 3.

At the end of slot 3, a spool 2 is positioned on plates 6 which are biased to support the spool so as not to allow its free discharge from bin 1. The spool 2, occupying an initial position at the end of groove 3 is gripped endwise and laterally by the fork member 7 with its freely rotating conical jaws 8, 9. Jaw 8 is displaced axially by electromagnet 10 which results in the spool being held fast. When the fork 7 moves, the gripped spool 2 is drawn downwardly out of the bin by rack 11 along guides 12. In the lower final position of the fork, jaw 9, through rubber roller 13, is frictionally rotated by the ever-moving rubber roller 14, to rotate spool 2 in a direction opposite to its direction of winding.

The air coming out of the tangentially oriented spool blowing funnel 15 sweeps aside the free end of the thread which enters aspirator 16 and under the backward rotation of spool 2 and the motion of funnels 15, 16 along guides 48*a*, 49*a* the free winding becomes untwisted.

When photoreflection element 19 installed on frame 18 receives a signal from reflection axis 20 of one of the sockets 21 in the magazine, the armature of electromagnet 22 attached to frame 18 moves axially and engages the slot 23 of indexing rail 24 associated with that particular socket, stopping the device 51 with the ramp 25 aligned with the socket 21 of the winding machine 50.

Movable jaw 8 of fork 7 goes back to its initial position after which the free spool is guided by ramp 25 to the socket 21 of the winding machine.

Under the effect of the vacuum created in pneumatic cylinder 27 by blower 46 through flexible air tube 44, fork 28 extends and takes up thread 29 and directs it to aspirator 30 of the winding machine where the resumed advance of the device 51 causes the fork 28 to sweep the thread 29 across the aspirator 30. Fork 28 is then returned to its initial position by the suction effect of blower 46 now directed through flexible air tube 39, attached to the back end of cylinder 27.

Scissors 36 supported on frame 18 at the end of the travel of aspirator 16, cuts thread 29, the free end of which is drawn into aspirator 30, opened by deviator 38 through electromagnet 37.

The various operations of the device 51 initiated by photoreflective element 19 can be controlled by standard programming devices known in the art or by the use of limit switches monitoring and triggering the various operations.

An example of these programming devices can be seen in the drawing, in which a controller 52 operates the drive motor 45 to advance the device 51 along the support rail 40 until the photoreflection device 19 detects an empty socket and sends a signal to the controller 52, which in turn stops the drive motor 45 while activating the electromagnets 22 and 31 to advance their respective armatures into respective slot 23 of indexing rail 24 and respective slot 33 of indexing rail 35, locking the device 51 in position with the trough 25 in alignment with the empty socket. The signal from photoreflective device 19 also causes the controller 52 to activate the motors 53 and 54 to advance a spool 2 to the discharge slot 3, where the fork 7 is in position with its arms 7*a* and 7*b* flanking the slot 3 with the jaws 8 and 9 in axial alignment with the spool 2, the controller 52 activating the electromagnet 10 to drive the jaw 8 into engagement with spool 2 and against the jaw 9, thereby gripping the spool. The motor 47 is then activated by controller 52, lowering the fork 7 with the captured spool 2 through the pivotable plates 6 to the bottom position of fork 7, triggering a limit switch 55, which sends a signal to the controller to deactivate motor 47 and to activate motors 48' and 49'. Motors 48' and 49' drive respective leadscrews 48 and 49 to advance the aspiration funnel 15 and blower funnel 16 along the length of spool 2, capturing the loose thread end there-from and delivering it to the scissors 36, the funnel 16 triggering limit switch 56, which sends a signal to the controller to deactivate electromagnet 10 and release spool 2, and to stop motors 48' and 49'.

The released spool 2 is guided by trough 25 to the empty socket 21, interrupting the light beam of photoreflective device 19 which signals the controller to start a sequence in which: a solenoid switching valve 57 opens flexible vacuum line 44, causing the fork 28 to extend and engage the thread 29; the drive motor 45 is activated to advance the device 51; the electromagnet 37 is activated to move deviator 38 to open aspirator 30 while the motion of device 51 causes fork 28 to swing the thread 29 past aspirator 30 to be captured thereby; the scissors 36 are activated to cut thread 29; switching valve 57 closes line 44 and opens vacuum line 39 to withdraw fork 28; motors 48' and 49' are reversed to return funnels 15 and 16 to the starting position, where another limit switch 56' deactivates these motors; and the motor 47 is reversed to return the fork 7 to the upper position, where a limit switch 55' deactivates motor 41. The device 51 continues to advance along support rail 40 until another empty socket 21 is detected by photoreflective device 19 and the entire sequence is repeated.

I claim:

1. A device for charging spools successively into the socket of a winding machine, said device comprising:

a support;

means for advancing said support along said winding machine;

a bin containing previously oriented spools mounted on said support and formed with a discharge slot;

a first fork displaceable on said support and having arms flanking said discharge slot, said arms being provided with opposite rotatable grip members engageable with opposite axial ends of a spool in said bin for withdrawing an engaged spool from said slot;

a pair of coplanar guides extending parallel to the axis of said spool engaged by said fork and disposed along the path of said spool withdrawn from said slot;

a blowing funnel on one of said guides and an aspiration funnel disposed on the other of said guides and means for displacing said funnels along said guides for respectively dislodging a thread end from said spool engaged by said first fork and drawing said dislodged thread end into said aspiration funnel;

means for directing said spool engaged by said first fork after the drawing of said thread end into said aspiration funnel into a respective socket of said magazine; and means hinged to said support for guiding said thread end drawn by said aspirator funnel to said winding machine.

2. The device defined in claim 1, further comprising a first electromagnet mounted on one of said arms of said first fork and an armature displacing the respective grip member toward and away from a spool disposed between said arms.

3. The device defined in claim 2, further comprising:

a rubber roller formed on the grip member of the other of said arms; and a first motor mounted on said support and provided with a first drive roller, said first drive roller frictionally engaging said rubber roller to rotate a spool engaged by said first fork when the latter is disposed between said guides in a sense opposite to the thread winding;

said means for advancing said support including a support rail mounted on said winding machine and frictionally engaged by a second drive roller provided on a second motor mounted on said support.

4. The device defined in claim 3 wherein said means for directing said spool includes a second electromagnet on said support having an armature receivable in a slot of a first indexing rail mounted on said winding machine for aligning a spool guiding trough with said socket.

5. The device defined in claim 4 wherein said means for guiding said thread end includes a third electromagnet on said support and having an armature receivable in a slot of a second indexing rail mounted on said winding machine and a second fork extendable toward said thread end and connected to said third electromagnet to be moved thereby in a sweeping motion across an aspirator mounted on said winding machine when said support is advanced.

6. The device defined in claim 5, further comprising a thread cutter disposed in the region of said aspiration funnel for cutting a thread end withdrawn thereby.

7. The device defined in claim 6, further comprising means including a photoreflection element responsive to the absence of a spool in one of said sockets for controlling said second electromagnet.

* * * * *